US009359051B2

(12) United States Patent
Stevens

(10) Patent No.: US 9,359,051 B2
(45) Date of Patent: Jun. 7, 2016

(54) SECURITY BULWARK TO PREVENT UNAUTHORISED BOARDING OF SHIPS

(71) Applicant: Guardian Barriers IP Limited, Hampshire (GB)

(72) Inventor: Teresa Mavis Stevens, Hampshire (GB)

(73) Assignee: Guardian Barriers IP Limited (GB)

( * ) Notice: Subject to any disclaimer, the term of this patent is extended or adjusted under 35 U.S.C. 154(b) by 77 days.

(21) Appl. No.: 14/358,294

(22) PCT Filed: Nov. 16, 2012

(86) PCT No.: PCT/GB2012/052856

§ 371 (c)(1),
(2) Date: May 15, 2014

(87) PCT Pub. No.: WO2013/072704

PCT Pub. Date: May 23, 2013

(65) Prior Publication Data

US 2014/0299036 A1 Oct. 9, 2014

(30) Foreign Application Priority Data

Nov. 17, 2011 (GB) ..... 1119841.3

(51) Int. Cl.
*B63B 17/00* (2006.01)
*B63G 13/00* (2006.01)
*B63B 17/04* (2006.01)

(52) U.S. Cl.
CPC ..... *B63G 13/00* (2013.01); *B63B 17/04* (2013.01); *B63B 2017/045* (2013.01)

(58) Field of Classification Search
CPC ..... B63B 17/00; B63B 17/04; B63B 17/045; B63B 2017/00; B63B 2017/0009; B63B 2017/0045; B63B 2017/04; B63B 2017/045; B63G 13/00
USPC ..... 114/343, 361, 364, 240 R, 241, 240 A, 114/240 B, 240 C, 240 D, 240 E
See application file for complete search history.

(56) References Cited

U.S. PATENT DOCUMENTS 1,322,576 A * 11/1919 Jasinki et al. ..... B63G 9/00 114/240 R
2,395,056 A * 2/1946 Luby ..... B63G 9/04 114/240 R (Continued)

FOREIGN PATENT DOCUMENTS

CN 201350963 Y 11/2009
CN 201357935 Y 12/2009

(Continued)

OTHER PUBLICATIONS

PCT Search Report, PCT/GB2012/052856, mailed Jan. 31, 2013.

(Continued)

*Primary Examiner* — Daniel V Venne
(74) *Attorney, Agent, or Firm* — Polster Lieder

(57) ABSTRACT

The security barrier (1) is formed of a plurality of modular security bulwarks (2) each adapted for removable attachment to the peripheral edges of a ship such as, but not limited to, a ship's rail. Each security bulwark consists of a skirt section (3) which lies adjacent to and substantially parallel with a ship's wall or railing a head section (4) and a rear wall (10). The head section (4) has a generally smooth outer surface that slopes downwardly and outwardly from its uppermost point (5) so as to form an overhang (6) which projects outwardly from the ship's railing with a cross-sectional depth greater than the reach of a convention roofing ladder. The security barrier (1) is able to deter unauthorized access to the ship by preventing the use of conventional roofing ladders and the overhang in combination with the smooth surface of the security bulwark make it difficult for an individual to climb over even with grappling hooks.

20 Claims, 2 Drawing Sheets

(56) References Cited

U.S. PATENT DOCUMENTS

| | | | | |
|---|---|---|---|---|
| 5,299,521 | A | 4/1994 | Loucks | |
| 5,671,692 | A | 9/1997 | Kimball | |
| 5,697,316 | A | 12/1997 | Kinkead | |
| 6,357,377 | B1 | 3/2002 | Santelli, Jr. | |
| 8,720,361 | B2 * | 5/2014 | DiBruno, Sr. ..... | B63G 13/00 114/240 D |
| 2012/0060744 | A1 | 3/2012 | DiBruno, Sr. et al. | |

FOREIGN PATENT DOCUMENTS

| | | | |
|---|---|---|---|
| CN | 201367101 | Y | 12/2009 |
| CN | 201411034 | Y | 2/2010 |
| CN | 101696593 | A | 4/2010 |
| CN | 201472648 | U | 5/2010 |
| CN | 201516914 | U | 6/2010 |
| CN | 101767639 | A | 7/2010 |
| CN | 201849636 | U | 6/2011 |
| DE | 102009059058 | A1 | 6/2011 |
| JP | 2001191983 | A | 7/2001 |
| KR | 1020110005586 | A | 1/2011 |
| WO | 2012111933 | A2 | 8/2012 |

OTHER PUBLICATIONS

International Property Office Search Report, GB1220689.2, dated Feb. 28, 2013 (from sister application).

* cited by examiner

SECURITY BULWARK TO PREVENT UNAUTHORISED BOARDING OF SHIPS

CROSS-REFERENCE TO RELATED APPLICATIONS

This application is a National Stage of International Application No. PCT/GB2012/052856, filed Nov. 16, 2012, that claimed priority to Great Britain application GB 1119841.3, filed Nov. 17, 2011. Further Great Britain application number GB 1220689.2, which is now granted Great Britain Patent No. GB 2496757, issued May 22, 2013) also claims priority to GB 111984.3 and is a sister application of GB 1119841.3. The disclosures of the above applications are incorporated herein by reference.

The present invention relates to a security barrier for use on ships to deter and preferably prevent unauthorised boarding of ships, for example by pirates. In a particularly preferred embodiment the security barrier is in the form of an improved bulwark for shipping.

Recent years have seen an upsurge in piracy particularly off the coast of Somalia and in the Indian Ocean as well as many other areas of the world's shipping trade routes. Usually pirates tend to board commercial shipping from skiffs using conventional roofing ladders.

To deter pirates armed guards are often employed by commercial shipping and flown to defend ships entering regions where piracy is considered likely. Barbed wire or razor wire has also been used as a deterrent when wrapped over or hung from the railings and the outer hull of a ship. For example in US 2012/0060744 a security barrier is shown adapted for releasable attachment to a ship's rail and is intended to hang down the side of the ship. The security barrier consists of an electrified net connected to a series of rolls of razor wire.

Also in CN201357935Y, CN201367101Y, CN101767639A and CN 201350963Y examples are given of known security barriers for shipping. In each case, the security barrier consists of a large diameter drum-shaped structure or part of a drum which is mounted over a ship's railings. However, these approaches have been notably unsuccessful. Moreover, due to the nature of the environment in which the security barriers are required to operate materials such as razor wire can quickly rust. This results in the razor wire becoming difficult and dangerous to handle and so it is often simply cut away from the ship and dumped at sea creating a significant risk to marine life. A simple yet effective approach to deter piracy is still sought.

The present invention seeks to address problems encountered with conventional shipping security barriers and seeks to provide an improved security barrier.

The present invention therefore provides a security bulwark for use on a ship, the security bulwark comprising a bulbous head section, a rear wall, a skirt and at least one first connector adapted to secure the security bulwark to a ship wherein the junction of the head section with the skirt forms an overhang extending away from the rear wall.

Preferably the rear wall and the skirt define there between a gap sized to receive a ship's railing. Moreover, the rear wall and the skirt may be substantially planar and substantially parallel with one another.

In a particularly preferred embodiment the rear wall and the skirt are spaced apart a distance of between 40 and 100 mm.

Furthermore, the skirt may extend below the bottom edge of the rear wall.

In a particularly preferred embodiment, the bulbous head section has a cross-section which describes an arc of a circle or an ellipse having a radius at least 1.5 times the height of the security bulwark.

The profile of the security bulwark may generally describe a 'P' shape with the spine of the 'P' intended to face towards the interior of the ship during use.

The first connector may be a bolt and a pair of bolt receiving aligned holes may be provided in the skirt and the rear wall. Alternatively the first connector may be a flexible strap, the skirt may include a bar for engagement by the strap and the rear wall may include a slot sized to accommodate the strap. Additionally, the security bulwark may include a plurality of first connectors which include at least one bolt and one flexible strap.

A second aspect the present invention provides a security barrier for use on a ship, the security barrier comprising one or more security bulwarks as described above.

Preferably the security barrier includes at least one second connector adapted to secure adjacent bulwarks together.

Thus, with the present invention, once mounted on a ship's railing, the security bulwark is sized and shaped to prevent conventional roofing ladders, boarding ladders or grappling hooks grabbing onto the ship from the seaward side. Moreover, even if a grappling hook and rope were to be successfully thrown over the security bulwark to engage with a piece of on-board deck equipment, the overhang of the security bulwark and the vertically smooth outer surface of the head section of the security bulwark make it extremely difficult for someone to successfully climb over the security bulwark using the grappling hook rope. In addition, the skirt of the security bulwark prevents seaward side access to any upright railing posts as the skirt overlies, and in a preferred embodiment presses inwardly towards, the deck edge.

Furthermore, the security bulwark and the security barrier of the present invention are low cost and easy to fit and interfere minimally with the normal working of the ship and its crew. Also, it may be noted that the security bulwark is easily removable and recyclable avoiding the need for the security bulwarks to be dumped at sea and so minimising risk to marine life.

It is to be understood that reference herein to the ship's railings is intended to also encompass any outer walls of the ship which act as a perimeters to the ship's exposed decking such as, but not limited to, any solid bulwarks.

Embodiments of the present invention will now be described by way of example only with reference to the accompanying drawings, in which.

Figure 1:
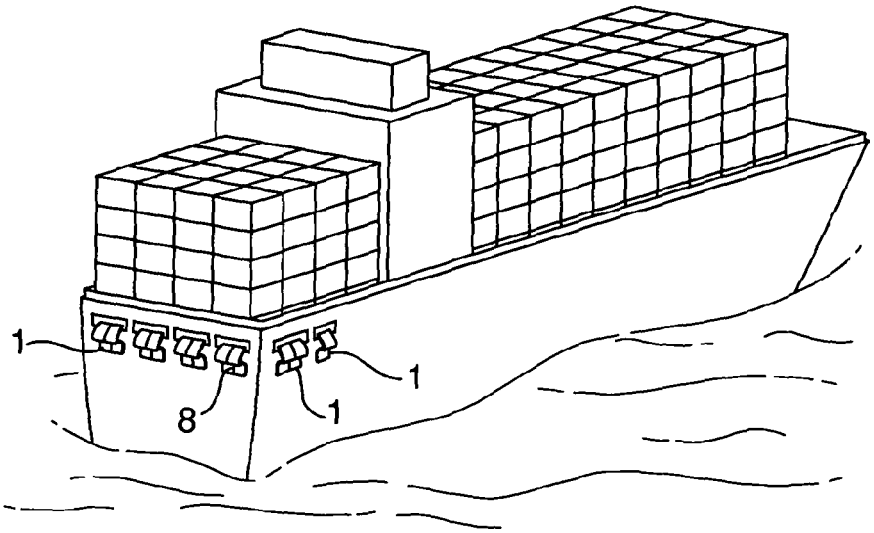
FIG. 1 illustrates two separate security barriers in accordance with the present invention mounted to the side of a ship.

A plurality of security barriers 1 mounted to a ship's railings 13 are shown in FIG. 1. Each security barrier 1 generally comprises one or more security bulwarks 2, each individually attached to part of the ship's railings 13. Where the security barrier 1 is formed of a plurality of security bulwarks 2, the side edges 8 of adjacent security bulwarks 2 abut one another so that the plurality of security bulwarks 2 presents a substantially continuous outwardly facing surface 7.

Each bulwark 2 is preferably formed using a reinforced plastics or other hard plastics material, such as polypropylene, and may be formed by rotational moulding or injection moulding. The security bulwark 2 is required to be resilient to impacts but sufficiently flexible to assist mounting the bulwark to the ship's railings 13. The body of the security bulwark 2 may be formed either as a single, unitary component or as a plurality of inter-engaging elements. In the latter case, for example, the front 9 (or seaward side) of the security bulwark and the rear 10 (or shipward side) of the security bulwark may be formed as separate components each including one or more snap-fit connectors for inter-engagement in a conventional manner.

Figure 2:
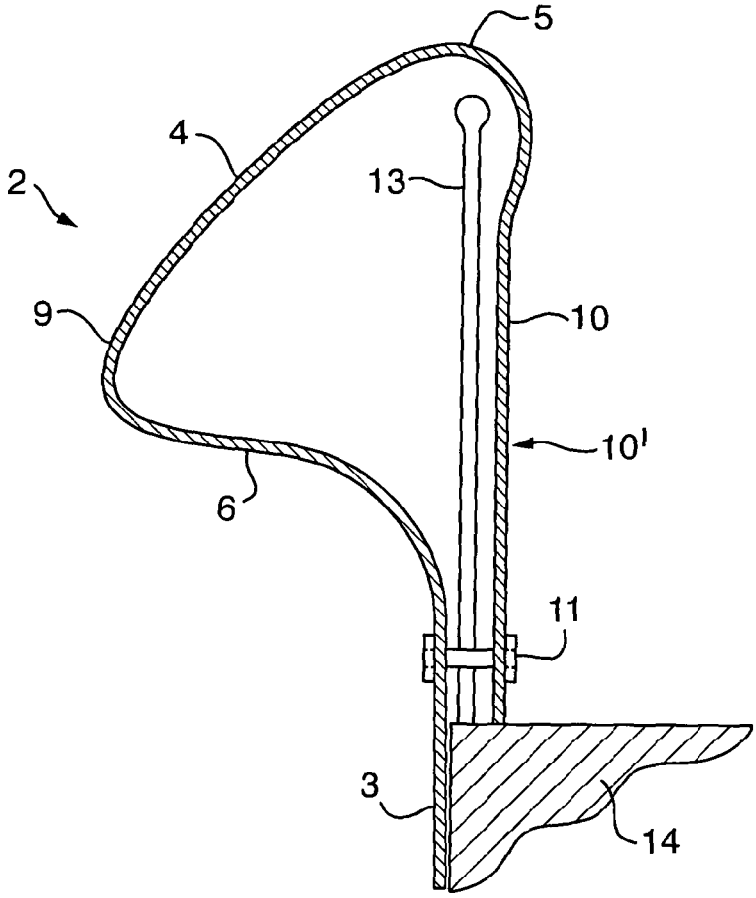
FIG. 2 is a cross-sectional view of a security bulwark in accordance with the present invention.

Features of the security bulwark 2 are more clearly shown in FIG. 2 and generally comprise a skirt 3, a head section 4, a rear wall 10 and one or more connectors 11. The walls of the security bulwark 2 define a hollow interior and preferably the walls have a thickness of between 4 and 10 mm. The rear wall 10 of the security bulwark 2 is arrange to stand adjacent to and substantially parallel with the ship's railings and so is adapted to take up only a small amount of deck-side space. For example, the surface 10' of the rear wall 10 facing away from the ship's railing is preferably only between 4 and 30 mm from the ship's railing 13, more preferably approx 5-10 mm. The security bulwark 2 is sized so that its uppermost point 5 is above the top of the ship's railings and its rear wall 10 extends downwardly to or adjacent the floor of the deck 14. Ideally the security bulwark is sized so that a man of average height is still able to look over the top of the security bulwark 2 and so in the case of most commercial shipping the height of the security bulwark 2 is between 1000-1500 mm, more preferably around 1200 mm.

Figure 3:
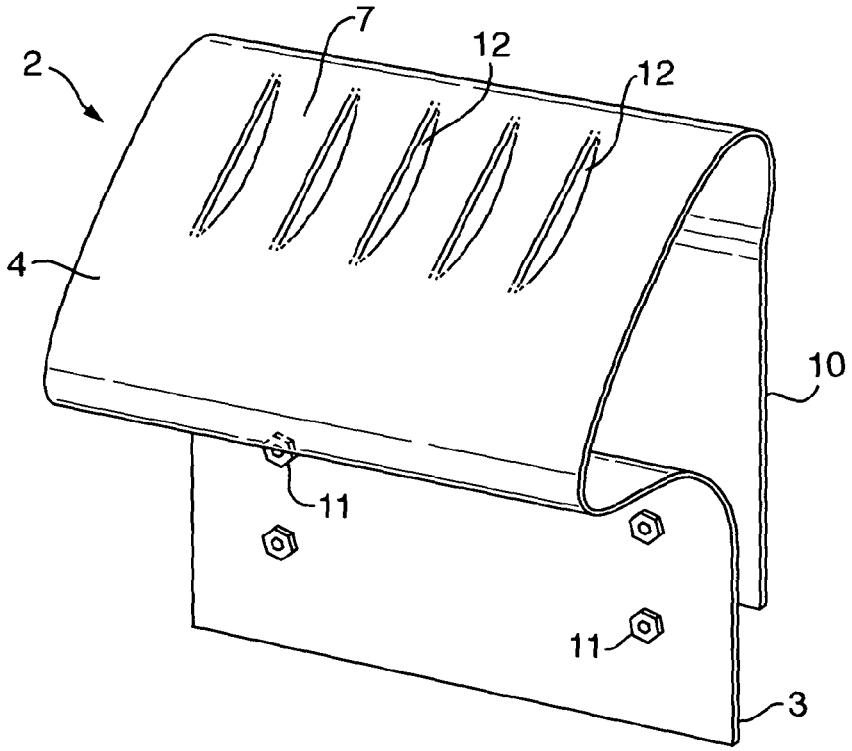
FIG. 3 is a perspective view from the front of a first embodiment of a security bulwark in accordance with the present invention.

The head section 4 of the security bulwark 2 is bulbously extends outwardly and downwardly from its uppermost point 5 to the seaward side (away from the rear wall 10). The outer surface of the head section 4 is generally smooth but includes one or more ridges or ribs 12 for added strength which extend generally downwardly away from the uppermost point 5 of the security bulwark but terminate short of the bottom of the head section 4. Five ridges are shown in FIG. 3 but more or fewer ridges may be present as necessary to maintain the security bulwark's structure. The security bulwark 2 has no lateral ridges or other surface discontinuities of sufficient size to provide a point of engagement for someone wishing to climb over the security bulwark. In cross-section the curve of the head section 4 preferably describes the arc of a circle or an ellipse with a radius greater than the height of the security bulwark 2, preferably at least 1.5 times greater than the height of the security bulwark 2. The head section 4 extends outwardly from the rear wall 10 preferably to a distance of at least 400 mm, more preferably 500-800 mm, more preferably still approximately 600 mm.

Below the head section 4 of the bulwark 2 a skirt 3 extends downwardly adjacent to and substantially parallel with the rear wall 10, and hence substantially parallel with the ship's railing when in use. The skirt 3 is preferably spaced from the rear wall 10 between 10 and 150 mm, more preferably 20-100 mm. Thus, in use, the skirt 3 is spaced in front of the ship's railing between 10 and 50 mm, more preferably 20-30 mm. The skirt 3 extends below the bottom edge of the rear wall 10 so that, when in use, the skirt overlies the edge of the ship's deck.

The upper region of the skirt 3 meets the lower edge of the head section 4 at an overhang 6. Ideally, as shown in FIG. 2, the overhang 6 comprises a first sharply curved section extending from the bottom of the head section inwardly towards the rear wall 10; a downwardly facing section, which in use is preferably substantially horizontal; and a second curved section which meets with the upper region of the skirt 3. Thus, the profile of the security bulwark 2 generally describes a 'P' shape with the spine of the always facing towards the interior of the ship.

To mount the security bulwark 2 on a ship's railing 13, the security bulwark 2 is held above the railing 13 and is then lowered over the railing 13 with the skirt 3 on the seaward side of the railing and the rear wall 10 on the ship side of the railing. The security bulwark 2 is lowered until the skirt 3 reaches at least the deck edge and preferably below the deck edge. At this point the ship's railing 13 may contact the inner surface of the security bulwark 2 or the bottom edge of the rear wall 10 may contact the deck 14. In a preferred embodiment the skirt 3 is required to flex slightly in order to pass over the deck edge.

Once in position the security bulwark 2 is secured to the ship's railing 13 using one or more connectors 11. The connectors 11 are preferably conventional in design. In one preferred embodiment the connector 11 is in the form of a bolt which passes through and extends between a pair of aligned holes provided respectively in the skirt 3 and the rear wall 10 so that the bolt secures the skirt 3 to the rear wall 10. The position of the holes in the skirt 3 and the rear wall 10 is selected so that when in place the bolt 11 is below a cross-member of the ship's railing. This prevents the bulwark from being lifted off the ship's railing without the bolt being undone. Four bolt apertures in the skirt 3 are shown in FIG. 3. The bolt 11 may be tightened so that the skirt 3 is held in tension against the deck edge.

Figure 4:
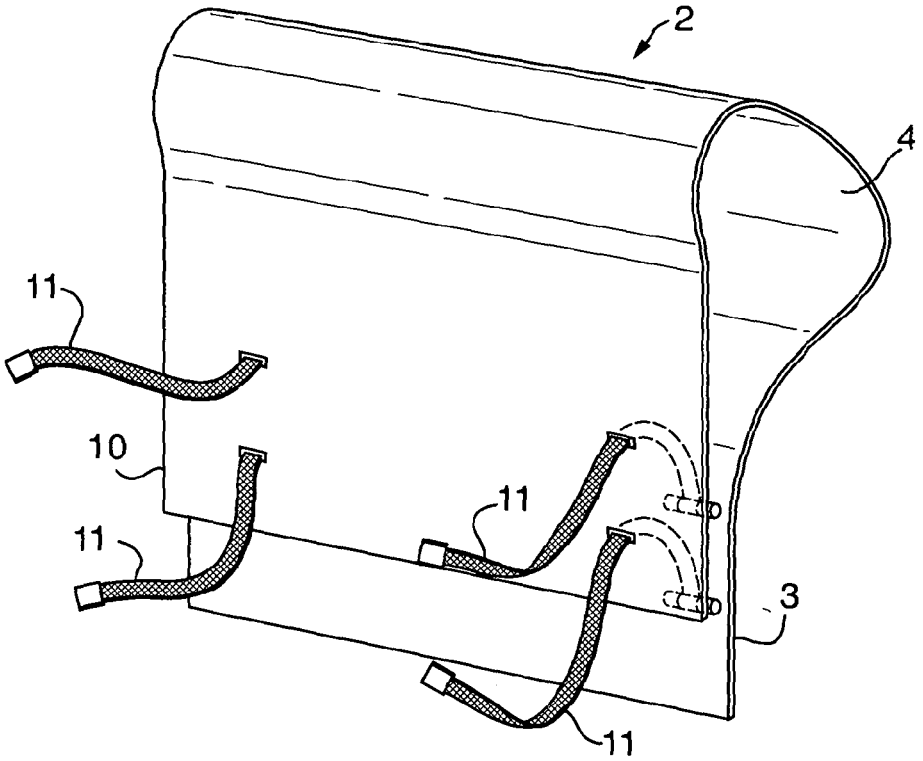
FIG. 4 is a perspective view from the rear of a second embodiment of a security bulwark in accordance with the present invention.

In an alternative embodiment shown in FIG. 4 the connector 11 is in the form of one or more flexible straps each of which wraps around a bar provided on the skirt 3 and which extends through an aperture provided in the rear wall 10. Four straps are shown in FIG. 4. The flexible strap may then be wrapped around deck equipment adjacent the railing such as, but not limited to, a ship's mooring fairlead, a mooring eye, or a winch control station. The strap is then either tied or otherwise secured, for example by means of a conventional clasp, to either itself or to a second strap. Here too, the strap can be used to put the skirt 3 under tension against the deck edge. Adjoining security bulwarks may be secured together using bolts, clip fittings, straps or other similar conventional connectors.

Once mounted on a ship's railing the security bulwark 2 is sized and shaped to prevent conventional roofing ladders, boarding ladders or grappling hooks to hold onto the security bulwark. Even if a grappling hook and rope were to be successfully thrown over the security bulwark to engage with some deck equipment, the overhang 6 and the smooth outer surface of the head section of the security bulwark make it extremely difficult for someone to successfully climb over the security bulwark using a grappling hook rope. Furthermore, the skirt 3 prevents access to any upright railing posts as the skirt overlies and in a preferred embodiment presses inwardly towards the deck edge. Ideally, the security bulwark is also brightly coloured so that it is visible from a distance. This enables the security bulwark to act as a visual deterrent long before pirates near the ship.

Although the security bulwark has been described herein as being rotational or injection moulded using a plastics material, it is also envisaged that the security bulwark may be manufactured using aluminium or steel or other similar metallic materials either alone or in combination with plastics material. Also, although the head section of the security bulwark is shown in the figures as an arc of a circle or an ellipse, other shapes are also envisaged and may also include a planar sloping surface.

The security bulwark and the security barrier described herein are low cost and easy to fit with the fitting of a security bulwark to commercial shipping being easily performed by a two-man team of average height and strength. Moreover, the security barrier does not include any feature that might present a risk to the ship's crew such as barbed or razor wire and the security barrier presents minimal interference with the normal working of the ship. Also, it may be noted that the security bulwark is easily removable and recyclable avoiding the need for the security bulwarks to be dumped at sea thereby minimising risk to marine life.

The invention claimed is:

1. A security bulwark configured for selective attachment to a part of a ship, the security bulwark comprising:

a bulbous head section having a front side and a rear side, a rear wall extending downward from the rear side of the bulbous head section, a skirt extending downward from the front side of the bulbous head section defining a junction between the bulbous head section and the skirt, and at least one first connector adapted to secure the security bulwark to the ship to which the bulwark is selectively attached, the junction between the bulbous head section and the skirt forming an overhang extending away from the rear wall above the skirt, wherein when the security bulwark is selectively attached to the part of the ship the rear wall is substantially planar and is substantially parallel with the part of the ship to which the security bulwark is secured, and the at least one first connector is attached to both the skirt and the rear wall.

2. A security bulwark as claimed in claim 1, wherein the rear wall and the skirt define there between a gap sized to receive a railing of the ship for the selective attachment thereto.

3. A security bulwark as claimed in claim 1, wherein the skirt is substantially planar and is substantially parallel with the rear wall.

4. A security bulwark as claimed in claim 1, wherein the rear wall and the skirt are spaced apart a distance of between 20 and 100 mm.

5. A security bulwark as claimed in claim 1, wherein the skirt extends below a bottom edge of the rear wall.

6. A security bulwark as claimed in claim 1, wherein the bulbous head section has a cross-section which describes an arc of a circle or an ellipse having a radius at least 1.5 times a height of the security bulwark.

7. A security bulwark as claimed in claim 1 wherein a profile of the security bulwark is generally in the shape of a letter P, a spine of the profile facing towards an interior of the ship when the security bulwark is selectively attached to the part of the ship.

8. A security bulwark as claimed in claim 1, wherein the first connector is a bolt and a pair of bolt receiving aligned holes are provided in the skirt and the rear wall.

9. A security bulwark as claimed in claim 1, wherein the at least one first connector is a flexible strap, the skirt includes a bar for engagement by the flexible strap and the rear wall has a slot sized to accommodate the flexible strap.

10. A security barrier configured for selective attachment to a part of a ship, the security barrier comprising one or more security bulwarks as claimed in claim 1.

11. A security barrier as claimed in claim 10, wherein the security barrier includes two or more security bulwarks, further comprising at least one second connector adapted to secure adjacent ones of the two or more security bulwarks together.

12. A security barrier of claim 10 wherein at least one of the bulbous head section, the rear wall and the skirt is formed as a separate component from a plastics material.

13. A security barrier of claim 10 wherein the bulbous head section, the rear wall and the skirt are a one piece body.

14. A security barrier of claim 12 wherein the one piece body is of a moulded plastic material.

15. A security bulwark configured for selective attachment to a part of a ship, the security bulwark comprising a bulbous head section having a front side and a rear side, a rear wall extending downward from the rear side of the bulbous head section and having a slot, at least one first connector including a flexible strap securing the security bulwark to the part of the ship to which bulwark is selectively attached;

a skirt extending downward from the front side of the bulbous head section and having a bar for engagement by the flexible strap, wherein the slot of the rear wall is sized to accommodate the flexible strap of the at least one first connector.

16. A security bulwark of claim 15 wherein the rear wall is substantially planar and is substantially parallel with a part of the part of the ship to which the security bulwark is selectively attachment.

17. A security bulwark of claim 15 wherein at least one of the bulbous head section, the rear wall and the skirt is formed as a separate component from a plastics material.

18. A security bulwark of claim 15 wherein the bulbous head section, the rear wall and the skirt are a one piece body.

19. A security bulwark of claim 15 wherein the rear wall and the skirt define there between a gap receiving a railing of the ship for the selective attachment thereto.

20. A security bulwark configured for selective attachment to a part of a ship, the security bulwark comprising a one piece body having a bulbous head section having a front side and a rear side, a rear wall extending downward from the rear side of the bulbous head section, and a skirt extending downward from the front side of the bulbous head section, wherein a junction of the bulbous head section with the skirt forms an overhang extending away from the rear wall; and at least one first connector securing the security bulwark to the part of the ship to which the bulwark is selectively attached.

* * * * *